United States Patent [19]

Williams

[11] Patent Number: 4,664,203

[45] Date of Patent: May 12, 1987

[54] BLADE SUPPORT FOR BULLDOZERS AND THE LIKE

[75] Inventor: Norman E. Williams, Park Ridge, Ill.

[73] Assignee: Dresser Industries, Inc., Dallas, Tex.

[21] Appl. No.: 779,002

[22] Filed: Sep. 23, 1985

[51] Int. Cl.[4] ..... E02F 3/76

[52] U.S. Cl. ..... 172/826; 172/827

[58] Field of Search ..... 172/824, 825, 826, 823, 172/827, 822

[56] References Cited

U.S. PATENT DOCUMENTS

| | | | |
|---|---|---|---|
| 2,452,774 | 11/1948 | Le Tourneau | 172/826 |
| 2,973,592 | 3/1961 | Abel | 172/823 |
| 3,049,821 | 8/1962 | Lichti | 172/826 |
| 3,539,021 | 11/1970 | Campen | 172/813 |
| 3,653,450 | 4/1972 | Rockwell | 172/826 |
| 3,901,329 | 8/1975 | Eftefield | 172/822 |
| 3,920,081 | 11/1975 | Terai | 172/813 |
| 3,941,195 | 3/1976 | Stedman | 172/827 |
| 4,153,117 | 5/1979 | Freese | 172/816 |
| 4,265,319 | 5/1981 | Seaberg | 172/811 |
| 4,311,200 | 1/1982 | Lebedev | 172/826 |
| 4,337,836 | 7/1982 | Seaberg | 172/826 |
| 4,405,019 | 9/1983 | Frisbee | 172/816 |

FOREIGN PATENT DOCUMENTS

| | | | |
|---|---|---|---|
| 703874 | 2/1954 | United Kingdom | 172/824 |

*Primary Examiner*—Richard J. Johnson

[57] ABSTRACT

Improved support structure for the blade of a bulldozer and the like wherein a first push arm is attached for swiveling movement to the tractor frame near the rear end thereof and extends into swiveling connection with the blade and a second push arm is attached to the opposite side of the tractor frame for swiveling movement relative thereto and extends to the blade and is pivotally connected thereto. A second end of the second push arm has a pair of spaced pivotal connections to the blade to provide lateral stability between the blade and the second push arm. An adjustable strut mounted on the first push arm is pivotally connected with the blade. A tilt cylinder is mounted on the second push arm and is connected with the blade. Actuation of the tilt cylinder in cooperation with the strut causes tilting of the blade. Bending stresses are avoided in the push arms due to the swivel connection between the push arm and the tractor frame and the swivel connection between the first push arm and the blade.

8 Claims, 11 Drawing Figures

BLADE SUPPORT FOR BULLDOZERS AND THE LIKE

BACKGROUND OF THE INVENTION

This invention relates generally to improvements in bulldozers and the like. More particularly, but not by way of limitation, this invention relates to an improved blade support method and structure for use on bulldozers and the like.

Wherever used hereinafter, "pivot," "pivoting," etc. shall mean a moveable connection between two parts with only one degree of flexibility, such as a simple hinge; and "swivel," "swiveling," etc. shall mean moveable connection between two parts with at least two degrees of flexibility, such as a U-joint or ball and socket.

In general, bulldozer blade supports are arranged so that the blade can be raised and lowered, pitched about an axis that extends generally perpendicularly to the longitudinal axis of the bulldozer, and tilted about an axis that extends generally parallel to the longitudinal axis of the tractor. Most often, the blade is supported by a pair of relatively long beams or push arms that extend parallel to the longitudinal axis of the tractor and are swivel mounted on the tractor or track frame near the rear end thereof. Due to the length of the push arms, the blade is not well supported against lateral loads. It is necessary, therefore, to provide some form of stabilizing structure for supporting the blade against lateral forces.

Usually, raising and lowering of the blade, which is located at the front of the tractor, is accomplished by attaching one or more double-acting hydraulic cylinders to the tractor and to the push arms in an arrangement that permits substantially vertical movement of the blade as the push arms rotate on their mountings near the rear end of the tractor.

Pitching of the blade is generally accomplished by manual adjustment of a threaded strut or turnbuckle mounted on the push arms located on the side opposite a double acting tilt cylinder. One end of the cylinder and the strut is attached to a respective push arm and the opposite end thereof is pivotally attached to the blade so that the simultaneous extension and retraction of the strut and tilt cylinder causes the blade to pivot or "pitch" about its attachment to the push arms.

Tilting of the blade utilizes the tilt cylinder mentioned above. Extension and retraction of the tilt cylinder imposes a twisting force on the blade which causes one end of the blade to rise and the opposite end of the blade to fall. The desired angle of tilt may be attained by adjusting the force exerted by the tilt cylinder in cooperation with the strut. As will be appreciated, when tilting of the blade occurs, the effective distance between the points at which the push arms are attached to the trunnion decreases with respect to their attachment to the dozer blade and, thus, the trunnion ends of the push arms effectively move closer together. Accordingly, bending stresses occur in the push arms if the arms are rigidly connected to the blade such as by diagonals extending generally horizontally between the arms and the blade.

Various structural arrangements have been utilized in an effort to alleviate the problems caused by the bending forces induced when the blade is tilted and caused by the lateral loads. It should be pointed out that the severity of the bending forces in the arms is increased by the attempts made to stabilize the blade and push arm structure against lateral forces. In other words, attempts to support the blade against lateral movement and attempts to eliminate the bending stresses are somewhat at counter purposes.

One apparatus used to stabilize the blade against lateral forces is illustrated in U.S. Pat. No. 3,901,329 issued to Larry G. Eftefield on Aug. 26, 1975. A similar structure is shown in U.S. Pat. No. 3,941,195 issued Mar. 2, 1976 to Robert N. Stedman. The structure illustrated in those patents ties either the blade to the main frame of the tractor to avoid lateral instability or ties one of the push arms to the main frame to avoid the lateral instability. Although lateral stability is attained, extremely high forces are imposed on the tractor frame which themselves result in other difficulties.

An additional attempt that has been made to alleviate such lateral instability has been to extend diagonal braces from the push arms to the blade to make a rigid structure thereof. Such rigidity results in the imposition of bending stresses in the push arms where the diagonal braces are attached to the push arms. With such an arrangement, care must be taken in the design to provide adequate structure to support the combined forces of external lateral loads and of the bending stresses.

Accordingly, an object of this invention is to provide an improved support structure for blades on dozers and the like which provides the desired lateral stability while avoiding the imposition of bending forces thereon when the blade is tilted.

SUMMARY OF THE INVENTION

This invention provides an improved method of and apparatus for supporting a blade that is useful on bulldozers. The apparatus includes a first push arm that is mounted for swiveling movement on the frame and that has another end connected to the blade for swiveling movement relative thereto. A second push arm is connected for swiveling movement on the opposite side of the frame and has its other end pivotally connected to the blade. The end of the second push arm connected to the blade has horizontally spaced pivotal connections to provide the lateral stability between the blade and the push arm structure. The end of the first push arm is mounted on the blade for at least two degrees of movement, thereby permitting that push arm, where connected to the blade, to pivot relatively toward the second push arm during tilting of the blade and avoid the imposition of bending stresses thereon.

In another aspect, the invention provides an improved method of supporting a bulldozer blade to provide lateral stability and to eliminate bending forces imposed by tilting the blade. The method comprises the steps of: mounting one end of an elongated first push arm on one side of a bulldozer for swivel movement thereon; mounting one end of an elongated second push arm on the other side of the bulldozer for swivel movement thereon; attaching the other end of the first push arm to the blade for at least two degrees of movement relative to the blade; and attaching the other end of the second push arm to the blade at two spaced connections for providing lateral stability to said blade, the arrangement permitting pivotal movement relative to the blade about a generally horizontal axis, and substantially preventing bending of the push arm along its length thereby avoiding the imposition of bending stresses due to tilting the blade as the effective distance between the trunnion ends of the push arms decreases.

BRIEF DESCRIPTION OF THE DRAWING

The foregoing and additional objects and advantages of the invention will become more apparent as the following detailed description is read in conjunction with the accompanying drawing wherein like reference characters denote like parts in all views and wherein.

DETAILED DESCRIPTION OF THE PREFERRED EMBODIMENT

Figure 1:
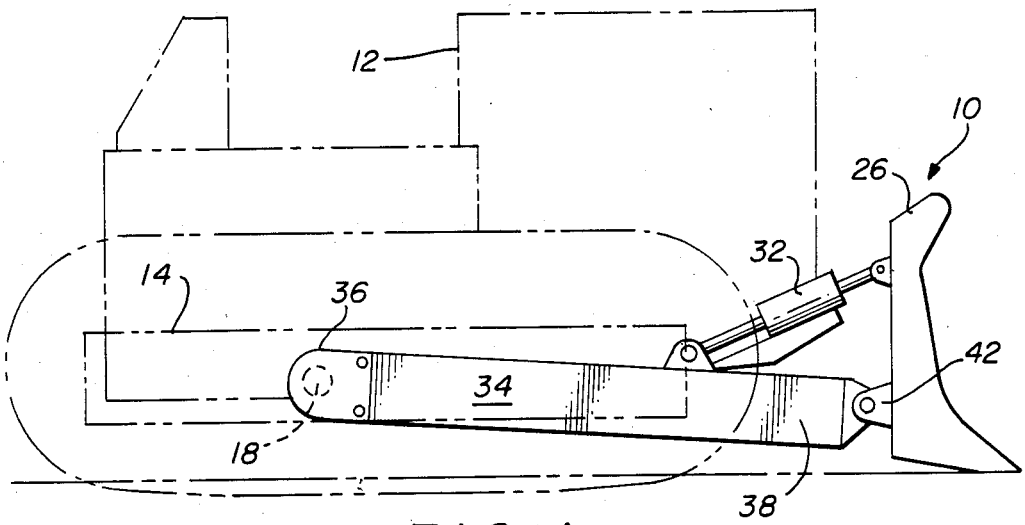
FIG. 1 is a side elevation view of a blade support structure, which is constructed in accordance with the invention, located on a bulldozer shown in ghost lines.
Figure 2:
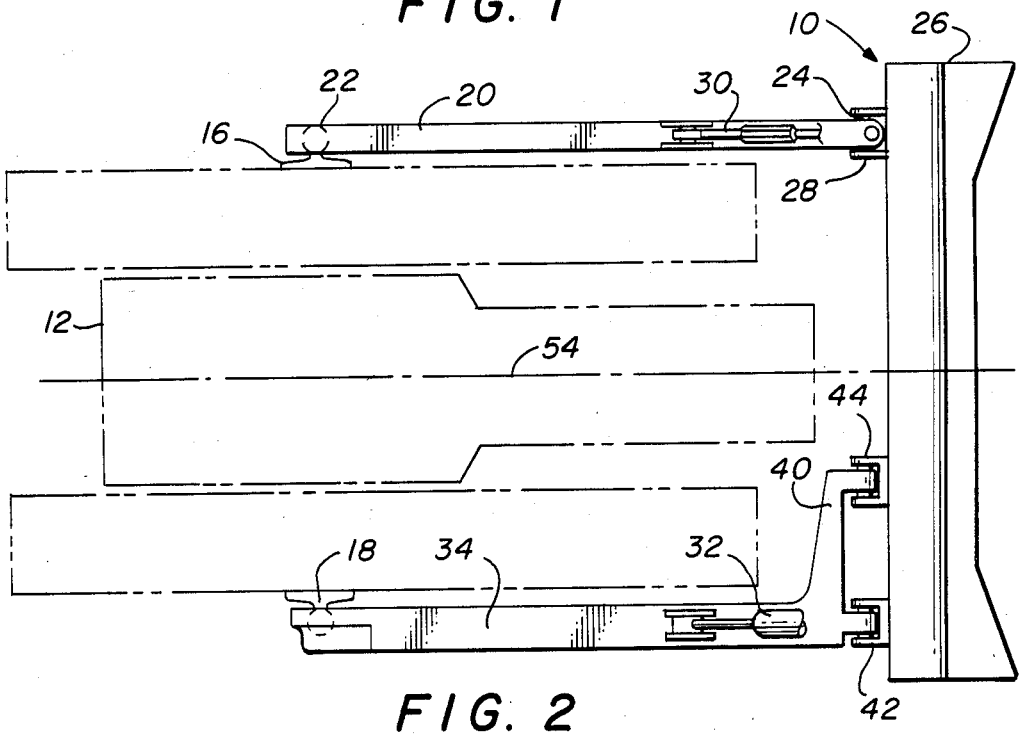
FIG. 2 is a top plan view of the structure illustrated in FIG. 1.

Referring to the drawing and to FIGS. 1 and 2 in particular, shown therein and generally designated by the reference character 10 is improved blade support structure that is constructed in accordance with the invention. The blade support structure 10 is illustrated as being mounted on a bulldozer 12 (shown in phantom lines). In the case of a tracked vehicle such as illustrated in 12, the vehicle will be provided with a track frame 14 which is also shown in phantom lines. In the case of a tired vehicle (not shown), the vehicle will include a suitable frame. Mounted on the frame 14 are left and right trunnions 16 and 18. As illustrated, the trunnions 16 and 18 are of the ball and socket type.

Attached to the trunnion 16 is a left push arm 20 which has an end 22 arranged for connection to the trunnion 16 in such a manner that the left push arm 20 will have three degrees freedom of movement relative to the dozer 12. The opposite end 24 of the left push arm 20 is connected to a dozer blade 26 by a universal type connection 28. The connection 28 provides for at least two degrees of freedom of movement of the arm 20 relative to the blade 26. If desired, the end 24 could be connected to the blade 26 by a ball and socket type joint providing three degrees freedom of movement.

Pivotally connected to the left push arm 20 is an adjustable strut 30. The opposite end of the strut 30 is pivotally connected to the blade 26. As shown therein, double-acting tilt cylinder 32 is pivotally mounted on the upper surface of a right push arm 34 and has its opposite end pivotally connected to the blade 26.

The rear end 36 of the right push arm 34 is connected to the trunnion 18 in such manner as to provide three degrees of freedom of movement of the arm 34 relative to the frame 14. The front end 38 of the right push arm 34 is pivotally connected to the blade 26. As can be seen most clearly in FIG. 2, the right arm 34 has an outrigger or a laterally projecting support member 40 extending along the blade 26. The arrangement provides a first pivot 42 connecting the right push arm 34 with the blade 26 and a second horizontally spaced pivot 44 also providing a connection between the right push arm 34 and the blade 26.

As can be seen in the drawing, the right push arm 34 has a substantially greater cross-sectional configuration than the left push arm 20. The right push arm 34 is designed to absorb and transfer all of the externally applied lateral loads on the blade 26 to the trunnion 18. The right push arm 34 absorbs and transfers such lateral loads due to the relationship between the lateral support member 40 and the push arm 34. The strength or rigidity designed into the push arm 34, and the dual connection of the push arm 34 with the blade 26 provides a rigid combination, except for the allowed pivotal movement. The left push arm 20 provides no support for lateral loads since each end of the left push arm 20 is attached to the tractor 12 and to the blade 26 for swiveling movement relative thereto.

Figure 3:
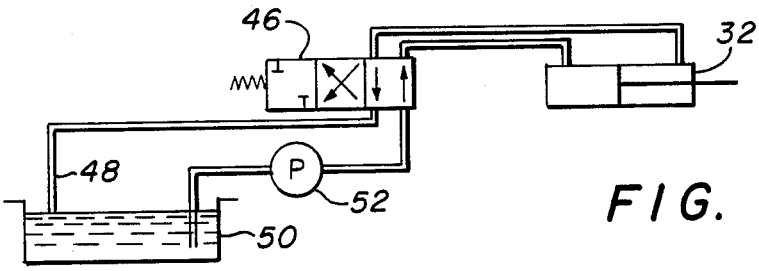
FIG. 3 is a schematic illustration of a circuit used in controlling a portion of the apparatus of FIG. 1.

FIG. 3 is a schematic illustration of a typical circuit that can be utilized to control the cylinder 32 and the pitch and tilt of the blade 26. As illustrated therein, the cylinder 32 is connected by appropriate conduits to a control valve 46. The valve 46 is connected by a return conduit 48 to a hydraulic reservoir 50. The valve 46 is of the three-way type permitting fluid to be supplied to either side of the piston located in the double-acting cylinder 32. The valve 46 is located in a convenient place for the operator of the dozer 12 and is normally controlled by manual operation so that the position of the cylinder 32 can be carefully controlled.

To provide fluid for actuating the cylinder 32, a pump 52 is connected to the reservoir 50 and its outlet is connected to the valve 46. When it is desired to pitch the blade 26, the valve 46 is positioned appropriately to cause the cylinder 32 to extend or retract pivoting the blade 26 about the pivots 28, 42 and 44.

When it is desired to tilt the blade 26, that is, to cause the blade to pivot about the longitudinal axis 54 of the dozer 12, the valve 46 is positioned so that fluid flows to the cylinder 32 to cause the cylinder 32 to be extended or retracted. The cylinder 32 works in opposition to the strut 30 imparting a twisting or torque to the blade 26 which is resolved into a lifting action on one corner of the blade causing the blade 26 to "tilt" generally about the longitudinal axis 54. The effect of such actuation can be seen clearly by comparing FIGS. 4 through 7.

Figure 4:
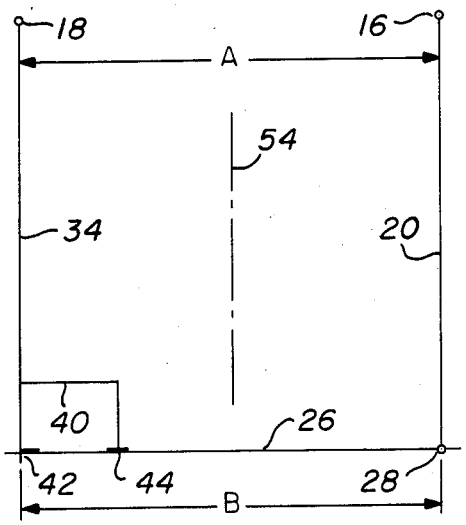
FIGS. 4, 5, 6 and 7 are free-body diagrams of the blade support arrangement of this invention.
Figure 5:
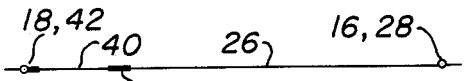

FIGS. 4 and 5 illustrate the blade support structure of this invention in the horizontal or untilted position. As shown in FIG. 4, the blade 26, which is represented by a single line, is rigidly retained at a right angle relative to the right push arm 34 by the lateral support member 40 and its connection with the blade 26 at 44 and by the pivot 42 and distances A and B are equal for purposes of illustration.

Figure 6:
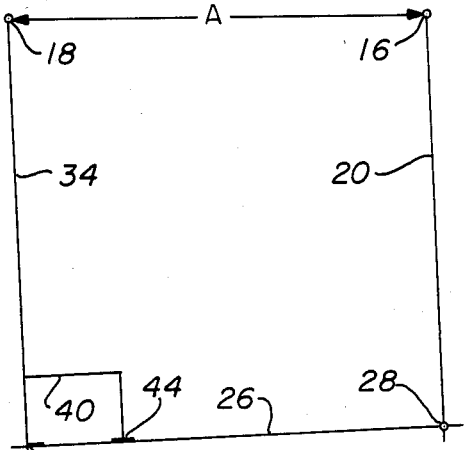
Figure 7:
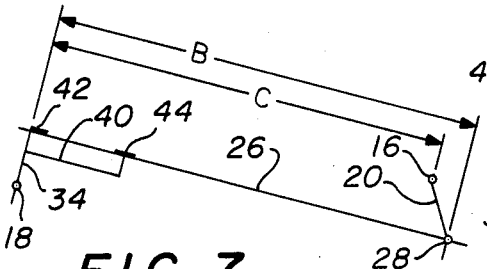

In FIGS. 6 and 7, the blade 26 has been tilted as can be seen by the disposition of the blade 26 in FIG. 7 (front view) as compared to FIG. 5. The right angle relationship is still maintained between the blade 26 and the right push arm 34. The pivotal attachment 42 between the right push arm 34 and the blade 26 has risen while the pivotal attachment 28 between the left push arm 20 and the blade 26 has moved down. When this occurs, the blade 26 shifts slightly to the left as can be seen more clearly in FIG. 6.

The dimension A represents the distance between the trunnions 16 and 18 which remains constant. The dimension B represents the horizontal distance between the push arms 20 and 34 at their attachment to the blade 26. As can be seen by comparing FIGS. 6 and 7 with FIGS. 4 and 5, the dimension C between push arm swivels 16 and 18 relative to the tilted blade structure is now less than the dimension B between pivots 28 and 42 at the blade 26. The swivel attachments 28 and 16 on the left push arm 20 permit the blade 26 to shift slightly to the left to avoid the imposition of bending stresses in the push arm 34. Thus, the push arms 34 and 20 are not subjected to the combined loads imposed by bending of the arms and forces exerted on the blade during the operation of the bulldozer. As previously pointed out, the right angle relationship between the right push arm 34 and the blade 26 is maintained, and thus any lateral loads imposed on the blade 26 are transferred to the dozer through the trunnion 18.

To illustrate more clearly the difference between the prior art structures and the blade support structure of this invention, FIGS. 4A–7A show one form of prior art blade support in direct comparison to the corresponding figures previously discussed with respect to the blade support structure of the invention.

The most obvious difference between the two support structures are the diagonal supports 41*a* and 29*a* which extend between the push arms 34*a* and 20*a* and the blade 26*a*, respectively. The diagonal supports are provided to maintain the relative right angle relationship between the blade 26*a* and the push arms.

Figure 4A:
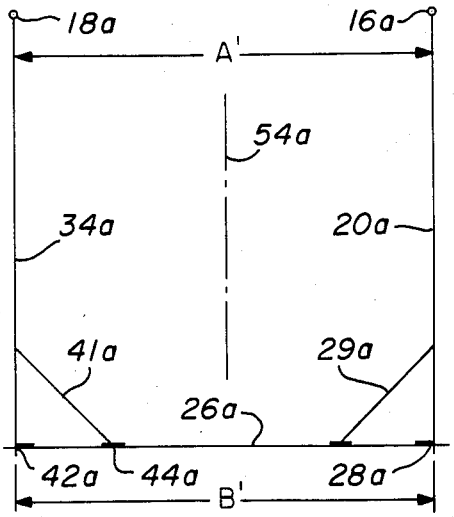
FIG. 4A (PRIOR ART)
FIGS. 4A, 5A, 6A and 7A are free-body diagrams of a blade connected and supported by a prior art arrangement.
Figure 5A:
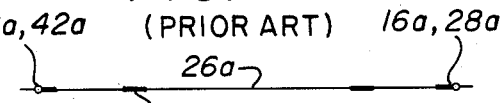
FIG. 5A (PRIOR ART)
Figure 6A:
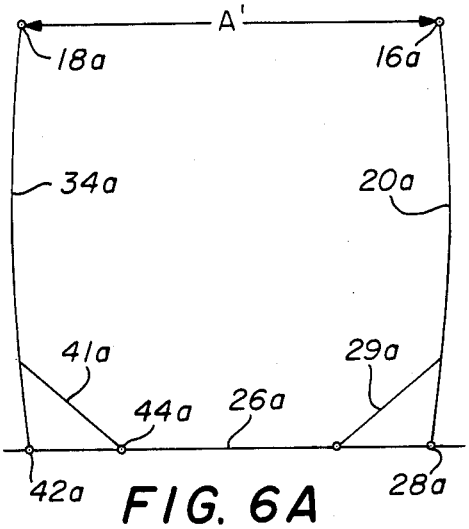
FIG. 6A (PRIOR ART)
Figure 7A:
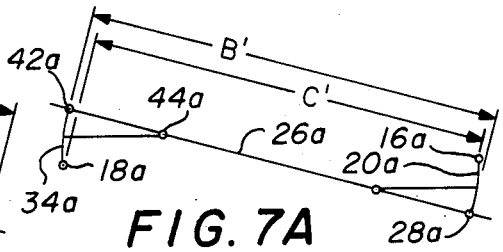
FIG. 7A (PRIOR ART)

FIGS. 4A and 5A are comparable to FIGS. 4 and 5 in that they illustrate the position of the blade 26*a*, push arms 20*a* and 34*a* when the blade 26*a* is in a horizontal or untilted position. FIGS. 6A and 7A illustrate the relationship of the structural components when the blade 26*a* has been tilted as illustrated in FIG. 7A.

The relationship between the blade 26*a* and the push arms 20*a* and 34*a* remains at a right angle at all times. Accordingly, and since the connections 28*a* and 42*a* rotate with the blade 26*a* as the blade is tilted, the push arms 34*a* and 20*a* must remain at the right angle relationship required by the diagonals 41*a* and 29*a*. The push arms must bend in to dimension C in order to satisfy the dimension A. Thus, the push arms 20*a* and 34*a* are subjected to combined stresses due to the bending forces imposed as a result of tilting plus those due to lateral and axial loads that are imposed on the blade 26*a* during operation of the dozer.

One further advantage of the structural arrangement of this invention is that the use of the lateral support member 40, maintains the right angle relationship between the push arm 34 and the blade 26 and permits shortening of the push arms with location of the blade 26 much closer to the front end of the dozer. This is apparent from FIG. 2 and by comparing FIG. 4 with 4A. As can be seen in FIG. 4A, the dozer must be positioned far enough from the blade 26*a* to permit the diagonals 29*a* and 41*a* to clear the vehicle tracks. The apparent advantage is that the push arms can be made shorter, saving material and increasing their rigidity, which results in lower pivot pin forces and less wear. Better machine balance is also obtained with the blade being closer to the vehicle and this allows the dozer to handle heavier external loads without losing its footing.

From the foregoing detailed description, it will be appreciated that the blade support structure 10 as described in detail herein provides effective support for the blade 26. The described structure provides lateral stability, avoids severe bending stresses in the push arms that are induced by tilting the blade, and avoids imposing side loads on the dozer frame supporting the engine.

Having described but a single embodiment, it will be understood that many changes and modifications can be made thereto without departing from the spirit or scope of the invention.

What is claimed is:

1. An improved support for a blade useful on a bulldozer that includes a frame, an adjustable strut, and a cylinder arranged to tilt the blade, the improvement comprising:

a first push arm having a first end connected to one side of the frame for swiveling movement relative thereto and having a second end connected to said blade and arranged for at least two degrees of movement relative thereto, thereby eliminating bending stresses on said first push arm resulting from tilting said blade; and, a second push arm having a first end connected to the other side of the frame and arranged for swiveling movement relative thereto and a second end extending along the blade, said second end having two horizontally spaced pivot connections pivotally connecting said second push arm to said blade about an axis fixed with respect to said blade for supporting said blade against lateral forces and for substantially eliminating bending stresses imposed on said second push arm by tilting said blade, said cylinder connected between the second push arm and the blade.

2. The support of claim 1 wherein the connection between said blade and said first push arm is aligned with the connection between said blade and second push arm to permit pitching of said blade.

3. The support of claim 2 and also including:

means for pivotally connecting said strut to said first push arm and to said blade; and, means for pivotally connecting the said cylinder to said second push arm and to said blade.

4. The support of claim 3 and also including means for controlling and actuating the cylinder to cause said cylinder to move to pitch said blade and to cause said cylinder to move in a direction to tilt said blade.

5. The support of claim 1 wherein the second end of said second push arm includes a lateral support member disposed in juxtaposition with the blade and carrying one of said connections, said lateral support member being substantially rigid with said second push arm and located proximate said blade.

6. An improved blade support structure for bulldozers and the like that include frame means and an elongated, generally horizontally disposed blade, the improvement comprising:

a first push arm having a first end connected to one side of the frame means near the rear end thereof for swiveling movement relative thereto and having a second end thereon attached to the blade for at least two degrees of movement relative to the blade;

a second push arm having a first end connected for swiveling movement relative to the frame means near the rear end thereof and on the opposite side of the bulldozer and having a second end thereon including two horizontally spaced pivot connections pivotally connecting said second push arm to said blade about an axis fixed with respect to said blade;

an adjustable strut mounted on said first push arm and connected to said blade for pivoting said blade about the connection between said blade and first push arm;

a tilt cylinder mounted on said second push arm and connected to said blade for pivoting said blade about the connection between the blade and second push arm; and, control means operably connected with said tilt cylinder for energizing said tilt cylinder for imposing forces on said blade in cooperation with said strut to tilt said blade.

7. A method of supporting a bulldozer blade tilted about a horizontal axis generally parallel to the longitudinal axis of the bulldozer for substantially eliminating bending forces imposed by tilting the blade and to provide lateral stability to the blade, the method comprising the steps of:

mounting one end of an elongated first push arm on one side of the bulldozer for swivel movement thereon;

mounting one end of an elongated second push arm on the other side of the bulldozer for swivel movement thereon;

attaching the other end of said first push arm to the blade for at least two degrees of movement relative to said blade;

attaching the other end of said second push arm to the blade at two spaced pivot connections for providing lateral stability to said blade and for permitting pivotal movement of said blade relative to said second push arm about a generally horizontal axis fixed with respect to said blade thereby providing tilting movement in the second push arm;

pivotally attaching one end of a tilt cylinder to said second push arm; and pivotally attaching the other end of said tilt cylinder to said blade relatively above the one of said two pivotal connections of said second push arm most nearly aligned with the elongated portion of said second push arm.

8. The method of claim 7 and also including the steps of:

pivotally attaching one end of an adjustable strut to said first push arm; and, pivotally attaching the other end of said strut to said blade relatively above the attachment of said first push arm to said blade.

* * * * *